US012352548B1

(12) United States Patent
Myers

(10) Patent No.: US 12,352,548 B1
(45) Date of Patent: Jul. 8, 2025

(54) SOFT REUSABLE GRENADE ROUND FOR TEAM-BASED SHOOTING GAME

(71) Applicant: Cherub Milsim, LLC, Broadway, NC (US)

(72) Inventor: Matthew Paul Myers, Broadway, NC (US)

(73) Assignee: Cherub Milsim, LLC, Broadway, NC (US)

( * ) Notice: Subject to any disclaimer, the term of this patent is extended or adjusted under 35 U.S.C. 154(b) by 0 days.

(21) Appl. No.: 18/659,203

(22) Filed: May 9, 2024

(51) Int. Cl.
*F42B 12/40* (2006.01)
*F42B 8/12* (2006.01)

(52) U.S. Cl.
CPC ..... *F42B 8/12* (2013.01)

(58) Field of Classification Search
CPC ..... F42B 12/40; F42B 12/46; F42B 12/50; F42B 8/14; F42B 8/16; F42B 6/10
See application file for complete search history.

(56) References Cited

U.S. PATENT DOCUMENTS 1,671,364 A * 5/1928 Gangnes ..... F42B 12/40 102/370
2,096,698 A * 10/1937 Lowy ..... F42B 12/50 102/370
2,409,380 A * 10/1946 Nichols ..... F42B 12/40 102/513
3,714,896 A * 2/1973 Young ..... F42B 12/34 102/431
3,865,038 A * 2/1975 Barr ..... F42B 12/40 102/502
3,894,492 A * 7/1975 Barr ..... F42B 14/068 102/513
4,128,059 A * 12/1978 Black ..... F42B 12/40 102/513
4,899,660 A * 2/1990 Brighton ..... F42B 12/40 102/513
5,033,446 A * 7/1991 Bradt ..... A01K 15/00 D22/100
5,035,183 A * 7/1991 Luxton ..... F42B 12/40 473/577
5,590,886 A 1/1997 Lush
5,996,503 A 12/1999 Woodall
6,145,441 A * 11/2000 Woodall ..... F42B 8/14 102/370
6,250,226 B1 * 6/2001 Leichter ..... F42B 12/50 102/370
6,378,439 B1 * 4/2002 Saxby ..... F42B 12/40 102/513
6,497,181 B1 * 12/2002 Manole ..... F42B 12/40 102/513

(Continued)

*Primary Examiner* — Derrick R Morgan
(74) *Attorney, Agent, or Firm* — Albert Bordas P.A.

(57) ABSTRACT

A soft reusable grenade round for team-based shooting game having a top shell assembly and a bottom shell assembly. The top shell assembly has a rounded top shell defining a cavity and at least one hole. The bottom shell assembly is removably coupled to the top shell assembly. The bottom shell assembly has a bottom shell defining an upper cavity and a lower cavity separated by an interior wall, and tabs separated by grooves in line around a perimetral surface of the bottom shell. The top shell assembly and the bottom shell assembly are reusable and made of a soft material such as rubber.

20 Claims, 5 Drawing Sheets

(56) References Cited

U.S. PATENT DOCUMENTS 6,619,211 B1 * 9/2003 Haeselich ..... F42B 12/38 102/513
6,871,594 B1 3/2005 Estrella
7,287,475 B2 * 10/2007 Brunn ..... F42C 19/083 102/444
7,526,998 B2 * 5/2009 Vasel ..... F42B 12/46 102/370
7,930,977 B2 * 4/2011 Klein ..... F42B 7/08 102/447
8,261,665 B1 9/2012 Walsh
8,286,557 B2 * 10/2012 Endicott ..... F42B 12/40 102/513
8,376,561 B2 2/2013 Longo
8,485,102 B2 * 7/2013 Carlson ..... F42B 5/045 102/370
8,746,146 B1 * 6/2014 Wiegand ..... F42B 7/10 102/513
8,844,444 B1 * 9/2014 Hooke ..... F42B 35/00 102/524
8,869,701 B2 * 10/2014 Aw ..... F42B 5/02 86/19.5
8,997,653 B1 * 4/2015 Calvert ..... F42B 12/54 102/439
9,068,807 B1 6/2015 Thomas
9,140,528 B1 * 9/2015 Thomas ..... F42B 12/36
9,157,715 B1 * 10/2015 Lafortune ..... F42B 12/40
9,527,081 B2 * 12/2016 Gibson ..... B01L 3/52
9,671,203 B1 * 6/2017 Lee ..... F42C 19/0823
9,766,049 B2 * 9/2017 Gibson ..... F42B 10/44
9,982,976 B1 * 5/2018 Van Valin ..... F42B 12/362
10,697,745 B2 * 6/2020 Cooper ..... F42B 12/367
11,209,254 B2 * 12/2021 O'Rourke ..... F42B 12/40
11,287,231 B2 3/2022 Stoddart
11,656,063 B2 * 5/2023 Doiron ..... F41A 21/24 102/430
2002/0178960 A1 * 12/2002 Ramaswamy ..... F42B 12/36 102/439
2003/0051627 A1 * 3/2003 Stogermuller ..... F42B 12/50 102/473
2003/0136293 A1 * 7/2003 Torsten ..... F42B 5/02 102/439
2005/0066841 A1 * 3/2005 Vasel ..... F42B 12/50 102/502
2005/0081734 A1 * 4/2005 Sharplin ..... F42B 12/40 102/482
2005/0229807 A1 * 10/2005 Brock ..... F42B 12/34 102/502
2005/0284325 A1 * 12/2005 Saxby ..... F42B 12/40 102/502
2006/0225600 A1 * 10/2006 Skellern ..... F42B 12/50 102/502
2007/0289475 A1 * 12/2007 Kapeles ..... F42B 12/745 102/502
2010/0078844 A1 * 4/2010 Kapeles ..... F42B 12/745 264/45.3
2011/0306446 A1 12/2011 Frank
2012/0006220 A1 * 1/2012 Endicott, Jr. ..... F42B 12/40 102/513
2012/0097062 A1 * 4/2012 Scanlon ..... F42B 8/14 102/513
2012/0199034 A1 * 8/2012 Gibson ..... F42B 12/40 102/517
2012/0220190 A1 * 8/2012 Corlett ..... F42B 6/003 446/473
2012/0291655 A1 * 11/2012 Jones ..... F42B 12/54 102/502
2013/0255525 A1 10/2013 Silva
2014/0026778 A1 * 1/2014 Saxby ..... F42B 12/40 102/502
2014/0305328 A1 * 10/2014 Dierks ..... F42B 12/44 102/363
2014/0318402 A1 * 10/2014 Carlson ..... F42B 30/02 102/524
2014/0373745 A1 * 12/2014 Carlson ..... F42B 12/74 102/502
2020/0109928 A1 * 4/2020 Omonira ..... A61K 33/06
2020/0109931 A1 * 4/2020 Pedicini ..... F42C 11/06
2021/0102789 A1 * 4/2021 Willson ..... F42B 5/067
2021/0270587 A1 * 9/2021 Lafortune ..... F42B 12/745
2021/0318106 A1 * 10/2021 Bruno ..... F42B 8/14
2023/0043976 A1 * 2/2023 Willson ..... F42B 12/40
2023/0194226 A1 * 6/2023 Longo ..... F21K 2/06 102/513
2024/0255266 A1 * 8/2024 Williams ..... F42B 12/40

* cited by examiner

SOFT REUSABLE GRENADE ROUND FOR TEAM-BASED SHOOTING GAME

BACKGROUND OF THE INVENTION

The present invention relates to grenades for team-based shooting games, and more particularly, to a soft reusable grenade round for team-based shooting game.

PRIOR ART

Applicant believes that one of the closest references corresponds to U.S. Patent Application Publication No. 20110306446 published on 2011 Dec. 15 to Frank Scott for Reusable Grenade. However, it differs from the present invention because Scott teaches a reusable, pneumatic paint grenade that includes a dashpot timing mechanism for sudden release of compressed air that ruptures a frangible housing to disperse a dyed liquid or airsoft pellets after the paint grenade is thrown. The dashpot further comprises a plunger located in a cylindrical body. A lever in contact with the plunger of the dashpot forces the plunger downward to puncture a cartridge of compressed air with a sharp structure disposed between the plunger and the cartridge. The compressed air is prevented from escaping while the sharp structure remains in the cartridge. Once the lever is released, the plunger is forced into substantially its original position by a biasing mechanism and the force exerted by the air pressure within the cartridge. The cylindrical body can be filled with a viscous liquid to further slow movement of the plunger.

Applicant believes that another reference corresponds to U.S. Pat. No. 9,140,528 B1 issued to Thomas; Toby D. on 2015 Sep. 22 for Covert Taggant Dispersing Grenade. However, it differs from the present invention because Thomas teaches a covert taggant dispersing grenade including: a shell, the covert taggant disposed in the shell; a dispersal apparatus operably associated with the covert taggant to disperse the covert taggant; and a propulsion section operably associated with the shell for propelling the shell through an atmosphere. A method for dispersing a taggant includes: launching a grenade containing a taggant over a target, the taggant being invisible in the spectrum of the human eye; and covertly dispensing the taggant over the target.

Applicant believes that another reference corresponds to U.S. Pat. No. 9,068,807 B1 issued to Thomas; Toby D. on 2015 Jun. 30 for Rocket-propelled Grenade. However, it differs from the present invention because Thomas teaches a rocket-propelled grenade that includes a payload section, a selectable fuzzing section joined to the payload section, and a propulsion section joined to the selectable fuzzing section. A rocket-propelled grenade includes a propulsion section and a payload section operably associated with the propulsion section. The payload section includes a shell, one or more penetrators disposed in the shell, and a charge for compromising the shell to deploy the one or more penetrators when the charge is initiated.

Applicant believes that another reference corresponds to U.S. Pat. No. 6,871,594 B1 issued to Estrella; Randall P. on 2005 Mar. 29 for Reusable Paint Grenade. However, it differs from the present invention because Randall teaches a reusable paint dispersing grenade of the type employed in paint ball games constructed in such a manner as to avoid the use of any combustible materials, and also to avoid the requirement for access to a source of compressed air for operation. The paint grenade of the invention has a hollow, fluid-tight casing defining an enclosed cavity that is divided internally into a marking paint chamber, a first propellant component chamber, and a second propellant component chamber. The propellant component chambers are each filled separately with propellant components, but remain isolated from each other until the paint dispersing grenade is used. At that time the propellant components chemically react with each other in a noncombustible manner to produce a quantity of gas under pressure. The expanding gas produced by the chemical reaction builds to a pressure sufficient to break a paint seal in the casing or a gas seal initially separating the gas from the paint, whereupon the gas under pressure forces the paint out through one or more paint expulsion ports. The device may be recharged with marking paint and the chemically reactive propellant components any number of times.

Applicant believes that another reference corresponds to U.S. Pat. No. 5,996,503 A issued to Woodall; Robert. on 1999 Dec. 7 for A Reusable Gas-powered Hand Grenade. However, it differs from the present invention because Woodall teaches a reusable gas-powered hand grenade having one or more launch tubes. A projectile is loaded in each launch tube with an obturator being positioned therein between the projectile and the launch tube's muzzle end. A sealed reservoir is maintained in the housing for storing a gas under pressure. A rupturing device is mounted in the housing for breaking the reservoir's seal upon impact therewith. A triggering mechanism coupled to the rupturing device maintains separation between the rupturing device and the seal until the triggering mechanism is activated. Once activated, the triggering mechanism moves the rupturing device to impact the seal so that gas pressure propels the projectile and obturator from the launch tube.

Applicant believes that another reference corresponds to U.S. Pat. No. 5,590,886 A issued to Lush; Craig L. on 1997 Jan. 7 for Reusable Paint Ball Grenade, Reloadable with Standard 0.68 Caliber Paint Balls. However, it differs from the present invention because Lush teaches a device designed to be grasped in such a way as to engage one or more safety interlocks during the removal of the safety pin. Once thrown downrange the actuator will function upon impact allowing the grenade halves to collapse with the force of the primary spring, crushing the paint balls against cutters and causing the paint to be hydromechanically dispersed about the exterior of the device. The device may be reloaded by expanding the two halves, thus compressing the primary spring, reinserting the safety pin, and reloading new paint balls.

Applicant believes that another reference corresponds to U.S. patent Ser. No. 11/287,231 B2, published on 2022 Mar. 29 to Stoddart; Robin for Reusable Simulated Weapon and Triggering Mechanism. However, it differs from the present invention because Stoddart teaches a reusable simulated weapon device including a holding chamber and an expansion chamber for receiving expanding gas. A shuttle is slidable between a closed position that blocks communication between the holding chamber and the expansion chamber and an open position that allows communication. A pilot valve allows pressurized gas in the holding chamber to drive the shuttle into the open position. A firing pin opens the pilot valve. The firing pin has an armed position, in which a protrusion engages with a recess to hold the firing pin against a spring. The firing pin can be released from the armed position in response to an impact to the device. When the firing pin is released, the spring drives the firing pin to actuate the pilot valve, causing the shuttle to slide from the closed position to the open position to allow gas to move into the expansion chamber.

Applicant believes that another reference corresponds to U.S. Pat. No. 8,376,561 B2, published on 2013 Feb. 19 to Longo; Joseph for Chemiluminescent Grenade. However, it differs from the present invention because Longo teaches a non-pyrotechnic, light emitting projectile for marking and illuminating a target. The projectile generally contains a main body having frangible side walls, at least one frangible ampoule containing chemiluminescent reactant components, a substantially incompressible filler material positioned between the frangible side walls and ampoule, and a first and second end cap. The first end cap is designed to be traversable between a first position and a second position upon impact with an object, thus provides a force sufficient to rupture the frangible side walls and ampoules. Rupture of the ampoules causes intermixing of the chemiluminescent reactant components and formation of a chemiluminescent slurry. The second end cap provides sufficient energy transfer to the chemiluminescent slurry upon impact with a target to disperse the chemiluminescent slurry radially and outwardly with respect to the longitudinal axis of the main body.

Applicant believes that another reference corresponds to U.S. Pat. No. 8,261,665, published on 2012 Sep. 11 to Walsh; Thomas Patrick for Fluid-marker Delivery Systems. However, it differs from the present invention because Walsh teaches a system relating to non-lethal gas-pressurized hand grenades used in the game of paintball, or other recreational war games. The system provides for an air-pressurized paintball grenade that is thrown or otherwise ballistic delivered to the target. The paintball grenade does not trigger until delivered to the target. It is constructed to be easily refilled and pressurized for repeated, safe, and environmentally friendly use. The paintball grenade comprises stabilizing fins, an integral hand-pump for pressurization, a trigger blocker, and attaching apparatus for carrying.

Applicant believes that another reference corresponds to U.S. Patent Application Publication No. 20130255525 A1, published on 2013 Oct. 3 to Silva; Everson Fortes for Paintball Impact Grenade. However, it differs from the present invention because Silva teaches a non-lethal hand grenade having a flexible resilient tube containing a pressurized colored liquid, with an impact actuated trigger device, which overcome the deficiencies of known prior art by offering a reliable, safe, and cost effective device that never fail to goes off when is thrown towards a intended target. The trigger device relies on the flexibility of the tube to keep the device safe to be thrown without going off until a minimal impact happens; The impact actuates a device which releases the trigger cap that keep the resilient tube blocked, allowing the pressurized liquid to be sprayed, marking anyone and anything about twenty feet of the point of impact. This non-reusable grenade is safe, reliable, environmentally safe, easy to manufacture and operate, very similar in design and use to a real military grenade.

Applicant believes that another reference corresponds to U.S. Patent Application Publication No. 20030136293 A1, published on 2003 Jul. 24 to Torsten, Werner for Reusable Grenade Cartridge. However, it differs from the present invention because Torsten teaches a grenade cartridge adapted to be fired from a firing tube, comprising a projectile, a cartridge and a propellant with primer. The grenade cartridge (1) is rechargeable by having a dividable, two-part cartridge such that a cartridge front portion (3), as seen in the firing direction, is tube shaped and in a first end thereof formed to receive the projectile (2) whereas the other end is formed to be detachably connected with a cartridge rear portion (4), and a separate propellant cartridge (9) with primer is axially supported in opposite directions by the two cartridge portions being mutually connected.

Other patents describing the closest subject matter provide for a number of more or less complicated features that fail to solve the problem in an efficient and economical way. None of these patents suggest the novel features of the present invention.

SUMMARY OF THE INVENTION

The present invention is a soft reusable grenade round for team-based shooting game, comprising a top shell assembly having a rounded top shell defining a cavity and a bottom shell assembly removably coupled to the top shell assembly. The bottom shell assembly comprises a bottom shell defining an upper cavity and a lower cavity separated by an interior wall.

The rounded top shell comprises at least one hole and an edge. The top shell assembly further comprises a threaded section that extends from the edge.

The bottom shell assembly further comprises a top edge, a bottom edge, and internal threads. The internal threads extends at an interior face of the bottom shell from the top edge to the interior wall.

The bottom shell assembly further comprises tabs and grooves in line around a perimetral surface of the bottom shell. In addition, the bottom shell has a plurality of holes in line above the tabs and grooves.

The top edge defines a first predetermined diameter and the bottom edge defines a second predetermined diameter. The first predetermined diameter is greater than the second predetermined diameter.

The interior wall may comprise a hole approximately at the center.

In a preferred embodiment, the top shell assembly comprises a plurality of holes around a top section of the rounded top shell.

The top shell assembly is removably coupled to the bottom shell assembly, whereby the bottom shell assembly receives the threaded section.

In a second embodiment, the top shell assembly comprises upper indents and lower indents around the rounded top shell and the top shell assembly comprises a base having a base hole.

The top shell assembly and the bottom shell assembly are made of a soft material such as rubber and are reusable.

The grenade is adapted to be used in recreational war games and the top shell assembly and the bottom shell assembly, when coupled, receive luminescent materials inside.

In a preferred or first embodiment, the soft reusable grenade round for team-based shooting game comprises a top shell assembly having a rounded top shell defining a cavity, and a plurality of holes around a top section of the rounded top shell; and a bottom shell assembly removably coupled to the top shell assembly, wherein the bottom shell assembly comprises a bottom shell defining an upper cavity and a lower cavity separated by an interior wall, and tabs separated by grooves in line around a perimetral surface of the bottom shell, wherein the top shell assembly and the bottom shell assembly are reusable and made of a soft material such as rubber.

In a second embodiment, the soft reusable grenade round for team-based shooting game comprises a top shell assembly having a rounded top shell and a base having a base hole, the rounded top shell is hollow and comprises upper indents and lower indents around the rounded top shell, and a hole at its top; and a bottom shell assembly removably coupled to the top shell assembly, wherein the bottom shell assembly comprises a bottom shell defining an upper cavity and a lower cavity separated by an interior wall and tabs separated by grooves in line around a perimetral surface of the bottom shell, wherein the top shell assembly and the bottom shell assembly are reusable and made of a soft material such as rubber.

It is therefore one of the main objects of the present invention to provide a soft grenade round for team-based shooting game, which is reusable.

It is another object of this invention to provide a soft reusable grenade round for team-based shooting game that may comprises pop snaps inside.

It is another object of this invention to provide a grenade round for team-based shooting game that is made of a soft material such as rubber.

It is another object of this invention to provide a soft reusable grenade round for team-based shooting game that is volumetrically efficient for carrying, transporting, and storage.

It is another object of this invention to provide a soft reusable grenade round for team-based shooting game that can be readily assembled and disassembled without the need of any special tools.

It is another object of this invention to provide a soft reusable grenade round for team-based shooting game, which is of a durable and reliable construction.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF DRAWINGS

With the above and other related objects in view, the invention consists in the details of construction and combination of parts as will be more fully understood from the following description, when read in conjunction with the accompanying drawings in which.

DETAILED DESCRIPTION OF THE INVENTION

Figure 1:
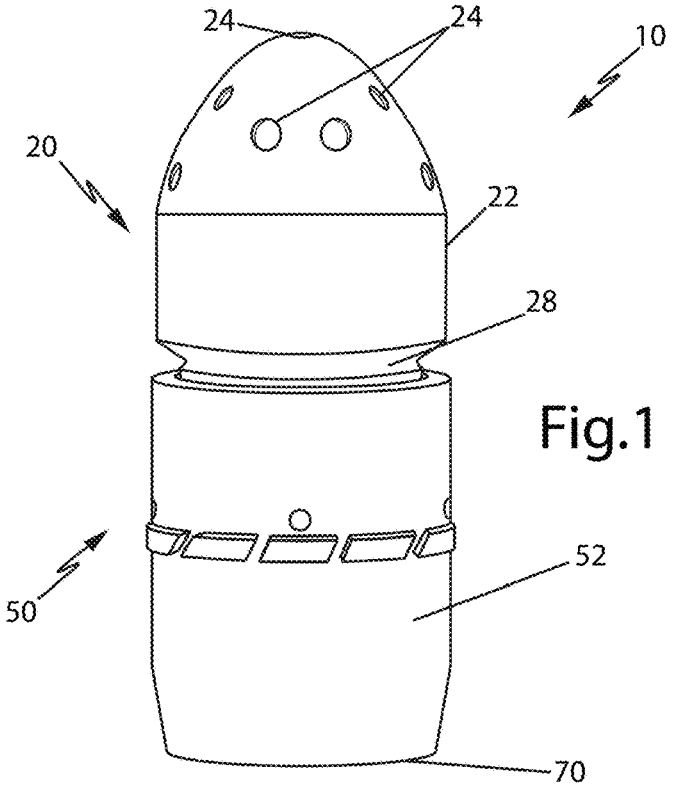
FIG. 1 represents a front view of the present invention.

Referring now to the drawings, the present invention is a soft reusable grenade round for team-based shooting game, and is generally referred to with numeral 10. It can be observed that it basically includes top shell assembly 20 and bottom shell assembly 50.

Figure 2:
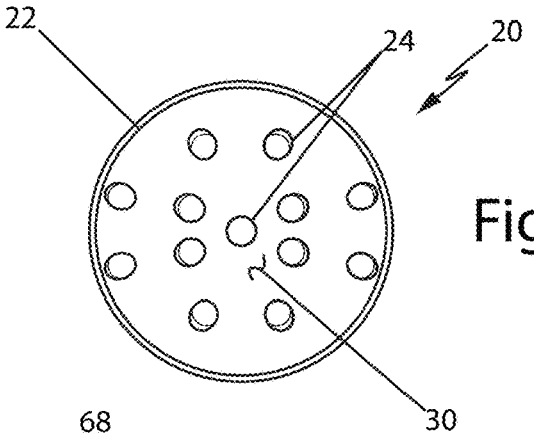
FIG. 2 is a bottom view of the top shell assembly of the present invention.

As seen in FIGS. 1 and 2, top shell assembly 20 and bottom shell assembly 50 are attached, whereby top shell assembly 20 is removably coupled to bottom shell assembly 50.

Top shell assembly 20 comprises rounded top shell 22 defining cavity 30. Rounded top shell 22 comprises at least one hole 24 and edge 28. Top shell assembly 20 further comprises threaded section 26 that extends from edge 28.

In a preferred embodiment, top shell assembly 20 comprises a plurality of holes 24 around a top section of rounded top shell 22.

Top shell assembly 20 and bottom shell assembly 50 are made of a soft material such as rubber and are reusable.

The grenade according to present invention 10 is adapted to be used in recreational war games.

Figure 3:
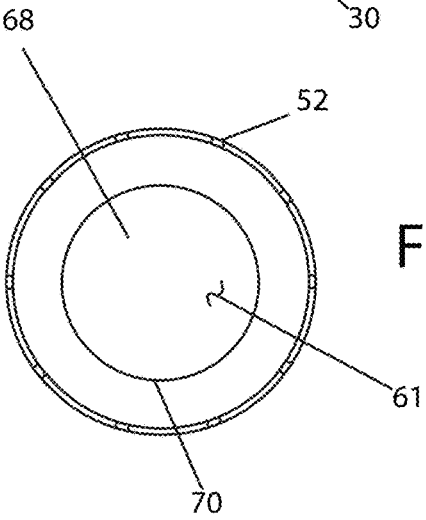
FIG. 3 is a bottom view of the bottom shell assembly of the present invention.
Figure 4:
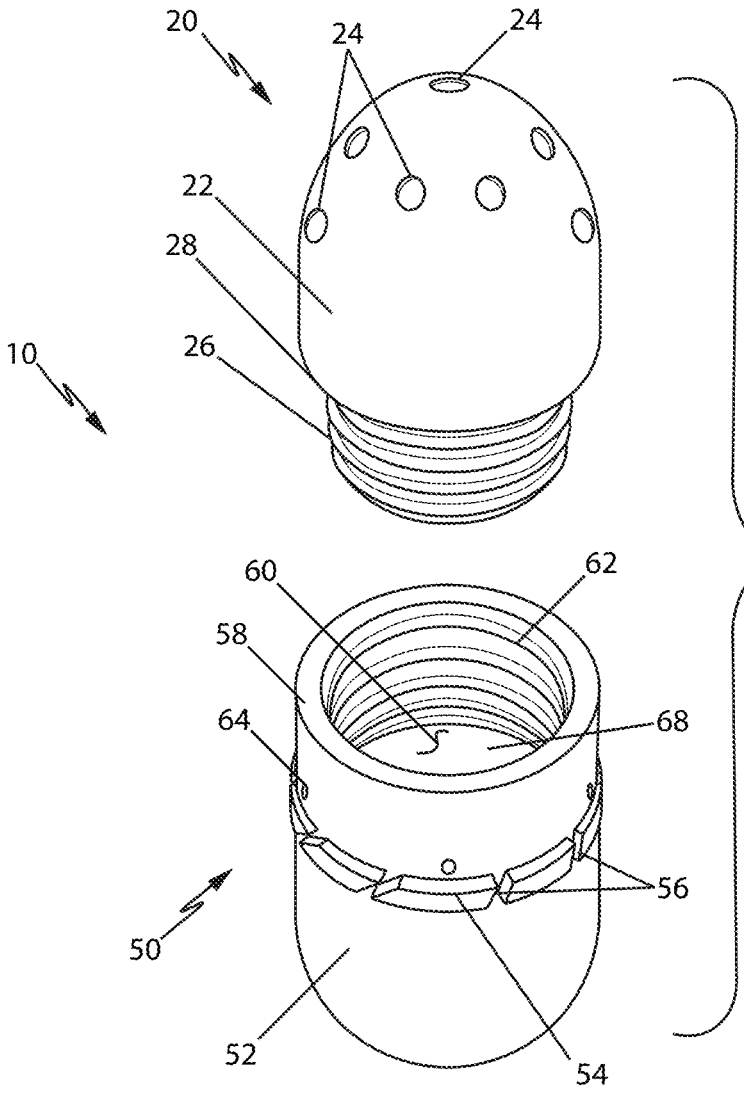
FIG. 4 is an isometric view of the present invention disassembled.

As seen in FIGS. 3 and 4, bottom shell assembly 50 comprises bottom shell 52 defining upper cavity 60 and lower cavity 61 separated by interior wall 68.

Bottom shell assembly 50 further comprises top edge 58, bottom edge 70, and internal threads 62. Internal threads 62 extends at the interior face of bottom shell 52 from top edge 58 to interior wall 68.

Bottom shell assembly 50 further comprises tabs 54 and grooves 56 in line around a perimetral surface of bottom shell 52. Grooves 56 defines a diagonal shape allowing present invention 10 to spin in the air.

In addition, around bottom shell 52 there are a plurality of holes 64 in line above tabs 54 and grooves 56.

Top edge 58 defines a first predetermined diameter and bottom edge 70 defines a second predetermined diameter. The first predetermined diameter is greater than the second predetermined diameter.

Top shell assembly 20 is removably coupled to bottom shell assembly 50, whereby bottom shell assembly 50 receives threaded section 26.

Figure 5:
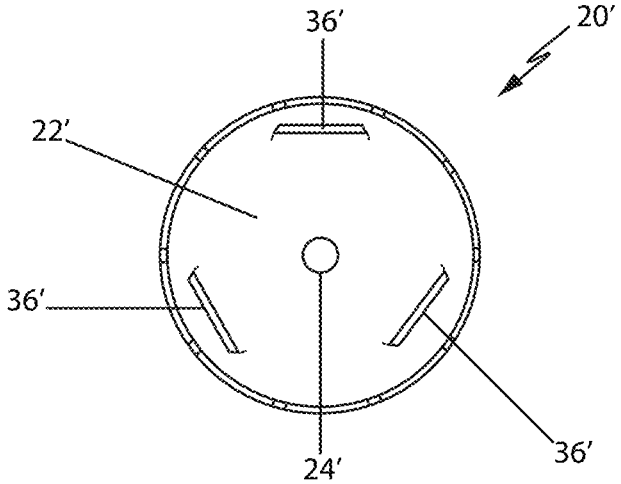
FIG. 5 is a top view of a second embodiment of the top shell assembly.
Figure 6:
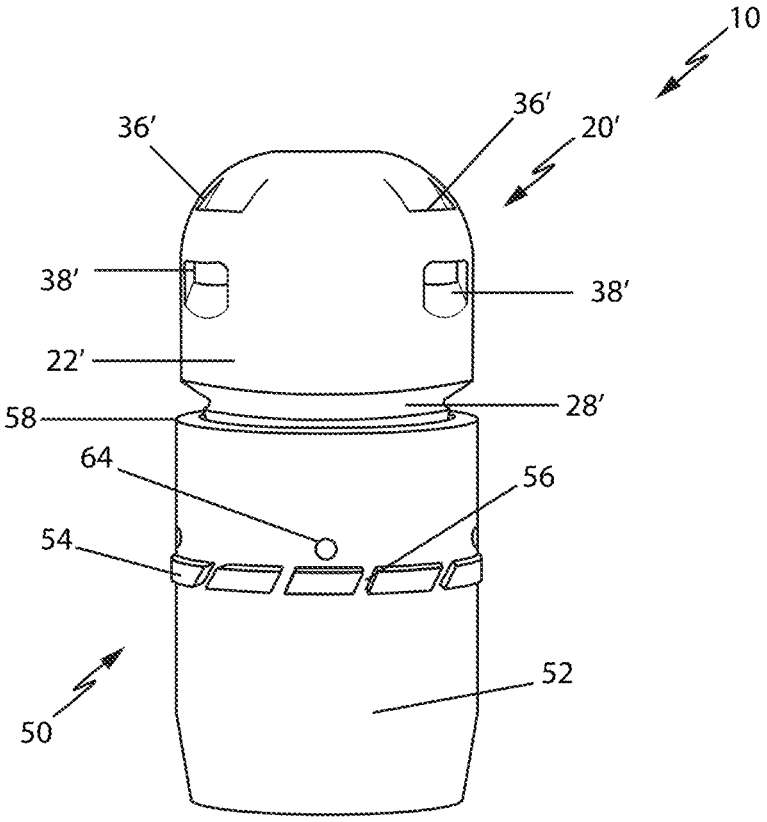
FIG. 6 is a front view of the second embodiment assembled.
Figure 7:
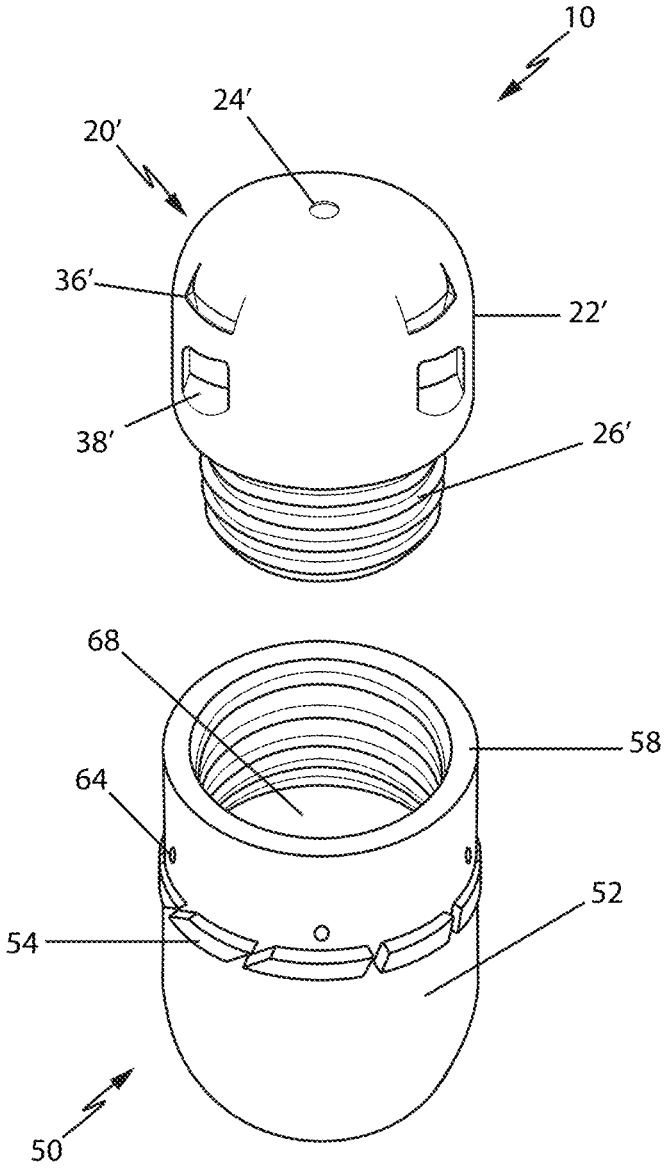
FIG. 7 is a front isometric view of the second embodiment disassembled.

As seen in FIGS. 5, 6, and 7, a second embodiment of present invention 10 comprises top shell assembly 20'. Top shell assembly 20' comprises rounded top shell 22', a single hole 24', threaded section 26' and edge 28'. Rounded top shell 22' is hollow.

Figure 8:
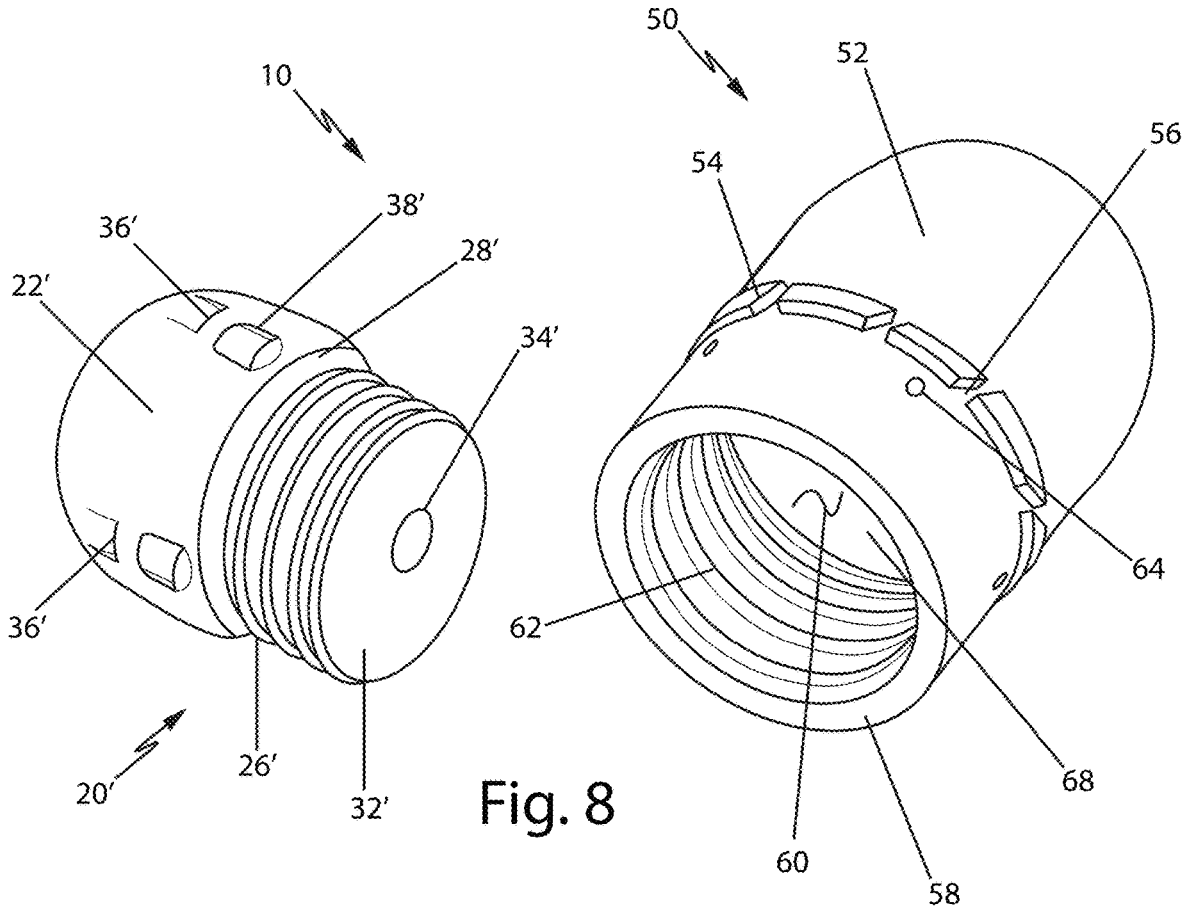
FIG. 8 is an isometric view of the second embodiment disassembled showing the interior part of the invention.
Figure 9:
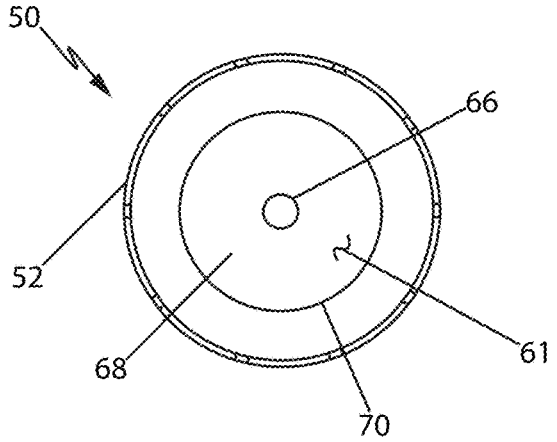
FIG. 9 is a bottom view of a second embodiment of the bottom shell assembly.

As seen in FIGS. 8 and 9, top shell assembly 20' further comprises upper indents 36' and lower indents 38' around rounded top shell 22'. Top shell assembly 20' further comprises base 32' having base hole 34'.

Fir this second embodiment, interior wall 68 comprise hole 66 approximately at the center.

Top shell assembly 20' and bottom shell assembly 50, are designed to receive luminescent materials inside, such as pop snaps.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A soft reusable grenade round for team-based shooting game, comprising:

A) a top shell assembly having a rounded top shell defining a cavity;

B) a bottom shell assembly removably coupled to said top shell assembly, wherein said bottom shell assembly comprises a bottom shell defining an upper cavity and a lower cavity separated by an interior wall;

wherein said bottom shell assembly further comprises tabs and grooves on a surface of said bottom shell; and wherein said bottom shell comprises a plurality of holes adjacent said tabs and grooves.

2. The soft reusable grenade round for team-based shooting game set forth in claim 1, wherein said rounded top shell comprises at least one hole and an edge.

3. The soft reusable grenade round for team-based shooting game set forth in claim 2, wherein said top shell assembly further comprises a threaded section that extends from said edge.

4. The soft reusable grenade round for team-based shooting game set forth in claim 1, wherein said bottom shell assembly further comprises a top edge, a bottom edge, and internal threads.

5. The soft reusable grenade round for team-based shooting game set forth in claim 4, wherein said internal threads extends at an interior face of said bottom shell from said top edge to said interior wall.

6. The soft reusable grenade round for team-based shooting game set forth in claim 1, wherein the tabs and grooves on the bottom shell are in line around a perimetral surface of said bottom shell.

7. The soft reusable grenade round for team-based shooting game set forth in claim 6, wherein the plurality of holes are in line above said tabs and grooves.

8. The soft reusable grenade round for team-based shooting game set forth in claim 4, wherein said top edge defines a first predetermined diameter and said bottom edge defines a second predetermined diameter.

9. The soft reusable grenade round for team-based shooting game set forth in claim 8, wherein said first predetermined diameter is greater than said second predetermined diameter.

10. The soft reusable grenade round for team-based shooting game set forth in claim 1, wherein said interior wall comprises a hole approximately at the center.

11. The soft reusable grenade round for team-based shooting game set forth in claim 1, wherein said top shell assembly comprises a plurality of holes around a top section of said rounded top shell.

12. The soft reusable grenade round for team-based shooting game set forth in claim 3, wherein said top shell assembly is removably coupled to said bottom shell assembly, whereby said bottom shell assembly receives said threaded section.

13. The soft reusable grenade round for team-based shooting game set forth in claim 1, wherein said top shell assembly comprises upper indents and lower indents around said rounded top shell.

14. The soft reusable grenade round for team-based shooting game set forth in claim 1, wherein said top shell assembly comprises a base having a base hole.

15. The soft reusable grenade round for team-based shooting game set forth in claim 1, wherein said top shell assembly and said bottom shell assembly are made of a soft material such as rubber.

16. The soft reusable grenade round for team-based shooting game set forth in claim 1, wherein said top shell assembly and said bottom shell assembly are reusable.

17. The soft reusable grenade round for team-based shooting game set forth in claim 1, wherein said top shell assembly and said bottom shell assembly when coupled receive luminescent materials inside.

18. The soft reusable grenade round for team-based shooting game set forth in claim 1, wherein said grenade is adapted to be used in recreational war games.

19. A soft reusable grenade round for team-based shooting game, comprising:

A) a top shell assembly having a rounded top shell defining a cavity, and a plurality of holes around a top section of said rounded top shell;

wherein said top shell assembly comprises a base which closes the cavity and the base having a base hole; and B) a bottom shell assembly removably coupled to said top shell assembly, wherein said bottom shell assembly comprises a bottom shell defining an upper cavity and a lower cavity separated by an interior wall, and tabs separated by grooves in line around a perimetral surface of said bottom shell, wherein said top shell assembly and said bottom shell assembly are reusable and made of a soft material such as rubber.

20. A soft reusable grenade round for team-based shooting game, comprising:

A) a top shell assembly having a rounded top shell, a base having a base hole, said rounded top shell is hollow and comprises upper indents and lower indents around said rounded top shell, and a hole at a top; and B) a bottom shell assembly removably coupled to said top shell assembly, wherein said bottom shell assembly comprises a bottom shell defining an upper cavity and a lower cavity separated by an interior wall and a bottom hole, and tabs separated by grooves in line around a perimetral surface of said bottom shell, wherein said top shell assembly and said bottom shell assembly are reusable and made of a soft material such as rubber; and wherein said bottom shell comprises a plurality of holes adjacent said tabs and grooves.

* * * * *